United States Patent [19]

Burton

[11] 4,222,088

[45] Sep. 9, 1980

[54] ELECTRONIC LOCK

[76] Inventor: Richard H. Burton, P.O. Box 57, Northboro, Mass. 01532

[21] Appl. No.: 946,270

[22] Filed: Sep. 27, 1978

[51] Int. Cl.[2] ..... E05B 49/00

[52] U.S. Cl. ..... 361/172; 340/147 MD

[58] Field of Search ..... 361/172; 340/147 MD, 340/149 R, 164 R; 307/10 AT

[56] References Cited

U.S. PATENT DOCUMENTS

| | | | |
|---|---|---|---|
| 3,751,718 | 8/1973 | Hanchett, Jr. | 361/172 |
| 3,784,839 | 1/1974 | Weber | 361/172 X |
| 3,845,362 | 10/1974 | Roe | 361/172 |

*Primary Examiner*—Harry E. Moose, Jr.

*Attorney, Agent, or Firm*—Carl P. Steinhauser

[57] ABSTRACT

An electronic lock having two normally open electrical contacts as input means, the closing and reopening of said contacts sequentially resulting in the entry of a binary code into a shift register. When the contents of the shift register match a predetermined but resettable programmed code, an integrating one-shot delay is triggered and a relay activated after the delay to open the lock. Momentary or continuous operation may also be programmed and reset for the lock. A power reset function is included to clear the shift register when initial power is applied or in the event of a power failure. The input means may be activated by a single three position, spring return switch or two push buttons.

8 Claims, 1 Drawing Figure

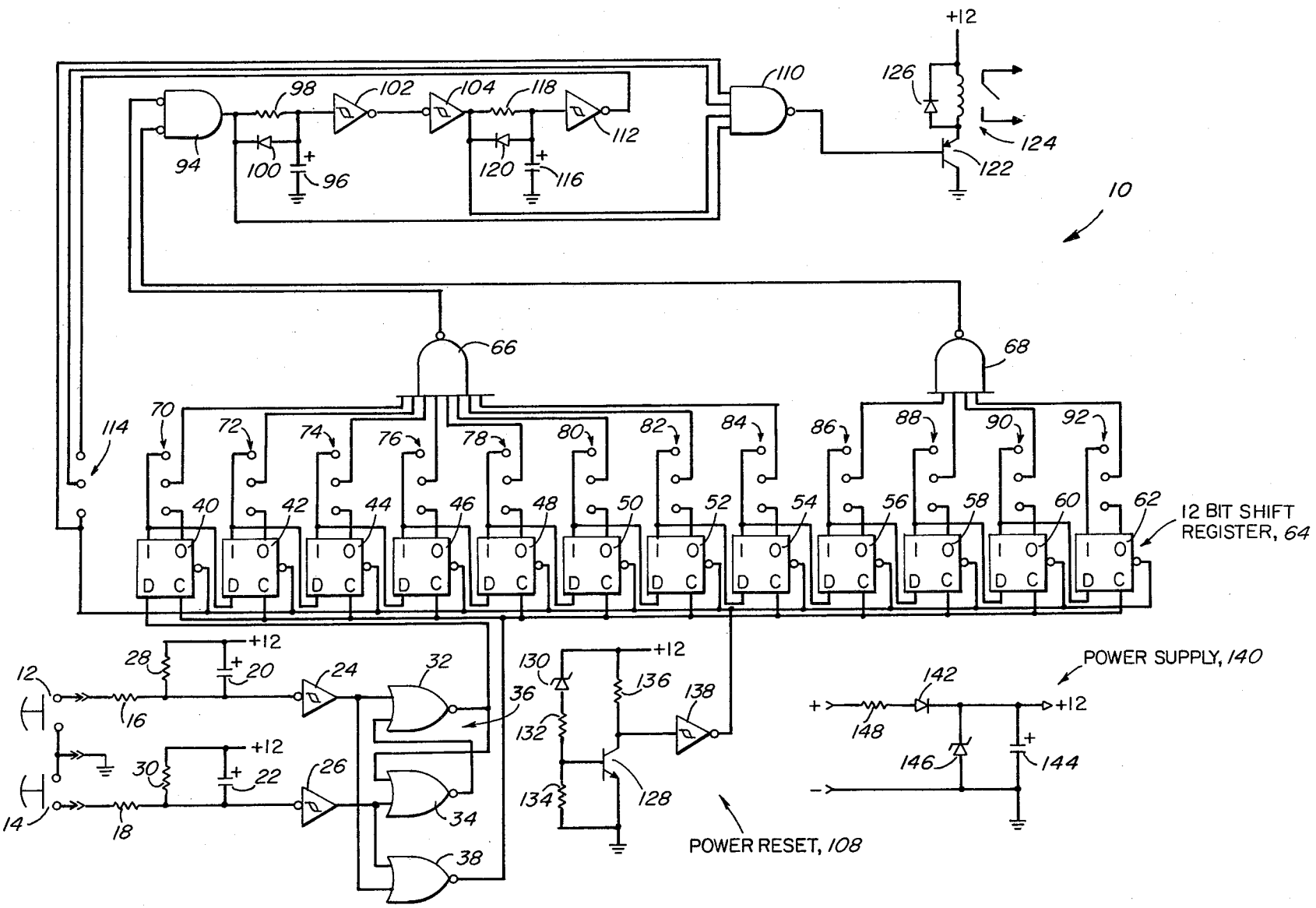
12 BIT SHIFT REGISTER, 64
POWER SUPPLY, 140
POWER RESET, 108
10
+12
124
122
126
110
112
116
118
120
104
102
96
98
100
94
68
66
92
90
88
86
84
82
80
78
76
74
72
70
62
60
58
56
54
52
50
48
46
44
42
40
114
142
144
146
148
136
138
128
130
132
134
36
32
34
38
24
26
20
22
28
30
16
18
12
14

ELECTRONIC LOCK

BACKGROUND OF THE INVENTION

1. Field of the Invention

This invention pertains to the field of electronic locking devices and, in particular, to switch operated electronic locks responsive to predetermined digital codes including means to change the codes simply and means to incorporate a multi-station capability. The lock of this invention is responsive to a predetermined but changeable code stored in a shift register, which code is generated by the manipulation of normally open contacts.

2. Description of the Prior Art

Electronic locking devices are well known in the prior patent art and many such devices are commercially available. Representative of the various types of prior art electronic locks are U.S. Pat. Nos. 3,978,376; 3,845,362; 3,953,769; and 3,831,065.

The prior art devices are effective but most have one or more of the following problems. Many such devices use cards or keys, either of which may be forgotten, lost or stolen, resulting in problems ranging from inconvenience to a breach of security. Many of such prior art devices use multiple switches or push buttons, resulting in a multiplicity of wires to the receiver, a higher than necessary cost and difficult installation. Many prior art devices lack versatility in that they are limited in their use due to size, cost or intrinsic design. Many prior art devices are simply too expensive for the average consumer.

The principal object of this invention is to provide an electronic lock which is extremely simple in design, inexpensive to manufacture, simple to install and use, and has a wide diversity of applications. Further objects of this invention are to provide an electronic lock in which keying is done by an easily installable spring return, center-off switch or a pair of push buttons; to provide a simple electronic lock which can be operated from more than one station; to provide both momentary and continuous modes of operation, the continuous mode being disabled by operating the key switch once; to provide an electronic lock in which the combination code and the mode of operation are settable and resettable by both the installer and/or the customer; and to provide a device which may be used in buildings and vehicles.

SUMMARY OF THE INVENTION

This invention pertains to an electronic lock which is responsive to the digital input of a predetermined but changeable code stored in a shift register. The input code is generated by the manipulation of two normally open contacts. These contacts can be in the form of two push buttons or keys or in the form of a single pole double pole, three-position switch having a spring to return the switch to the center-off position. For purposes of the invention one contact is assigned the binary representation "0" and the other contact is assigned the binary representation "1". The closing of a contact causes the respective binary contact number to be presented to a shift register. The opening of the contact shifts the value of that contact into the shift register and simultaneously shifts all previously inserted values in the shift register. When the binary code number in the shift register agrees with a predetermined code number stored in the lock, a timer is started. At the end of a fixed length of time, the output of the shift register is enabled for a fixed time of continuously, as determined beforehand, to enable the user to open the lock. If a user attempts to enter code numbers after the correct code has been reached, the shift register will continue to shift bit positions and the user will not be able to open the lock. A twelve-bit shift register is used. The chances of breaking a code are over 4000 to 1. A reset circuit is included (in the power switch) to clear the shift register when the device is turned on or after an interruption of power.

This electronic lock is designed for ease of input connection. Only a three conductor wire is needed. In most installations the input means is physically separated from the lock, which is in a secured area. The input is simple to use since only one switch or two buttons are required. This is particularly helpful for physically handicapped persons. Also, the input station may be easily disguised and made spy proof as an additional security feature. It can also be made to withstand any environmental conditions. Multiple input stations can be utilized because they can be easily paralleled. Multiple coding is also possible because logic cards can be easily paralleled. This could be utilized to implement duress alarms and/or master/grandmaster schemes. In construction of this lock CMOS is used with 12 V AC or DC power input.

BRIEF DESCRIPTION OF THE DRAWINGS

FIG. 1 is a schematic drawing of the electronic lock of this invention.

DESCRIPTION OF THE PREFERRED EMBODIMENT

Referring now to the drawing, the electronic lock system of the present invention, designated generally by the reference number 10, incorporates two input contacts 12, 14, contact 12 representing the binary number "0" and contact 14 representing the binary number "1". Input contacts 12, 14 are installed in a suitable housing and closed by either two keys or a single pole double pole three-position switch having a spring return to the center-off position, and input contacts 12, 14 are remotely located from the digital logic of device 10. Input contacts 12, 14 are located in an area accessible to the user, while the logic of device 10 is physically separated and located in a secured area. Resistors 16, 18 control the current available to input contacts 12, 14 respectively when these contacts are closed. Resistors 16, 18 also protect against damage to the logic that might be induced through misconnection. Closing or input contact 12 or 14 charges a capacitor 20 or 22 respectively. When capacitors 20, 22 are charged to approximately two-thirds Vcc (in the embodiment illustrated Vcc is approximately 12 volts), input schmitt triggers 24, 26 recognize a low. Resistors 28, 30 serve to discharge capacitors 20, 22 respectively when input contacts 12, 14 are released or reopened. When capacitors 20, 22 discharge to approximately one-third Vcc, the input schmitt triggers 24, 26 recognize a high. Capacitors 20, 22 serve to filter out any aberations due to the bouncing of input contacts 12, 14. Gates 32, 34 are cross-wired in such a way as to form an R-S flip-flop 36. The state of this flip-flop is determined by the last contact 12, 14 released. The output of gate 38 goes high upon the last contact released. Flip-flops 40 through 62 are wired in such a way as to form shift register 64.

Flip-flop 40 is presented with data (in the form of a "0" or "1") from R-S flip-flop 36 formed by gates 32, 34. The data in shift register 64 is shifted from left to right when a low to high transition appears from the output of gate 38. This transition is the clock signal. When the input contacts 12, 14 are pushed according to a memorized code for a total of twelve strokes, shift register 64 is fully loaded with the code.

In order to activate electronic lock 10, the inputs of gates 66, 68 must be high. Accordingly, programming jumpers are placed on contacts 70 through 92 such that the inputs of gates 66, 68 are connected to the "0" or "1" outputs of the respective flip-flops 70 to 92, whichever is high when the code is loaded into shift register 64. When the inputs to gates 66, 68 are high, then their outputs are low. When this occurs, the output of gate 94 goes high. The output of gate 94 will go high whenever the correct code has been entered into shift register 64. When this happens, capacitor 96 charges through resistor 98. Resistor 98 and capacitor 96 combine to yield a delay of approximately two seconds. Diode 100 serves to discharge capacitor 96 quickly when the output of gate 94 goes low, thereby resetting the delay. Gates 102 and 104 serve as buffers, enabling the output via an insert to gate 110.

This happens approximately two seconds after the correct code is entered into shift register 64. Another input can be connected to the power reset 108 (which is already connected to an input of gate 110) or to the output of gate 112 by programming jumper 114. If this input is connected to power reset 108 by jumper 114, lock 10 is programmed for continuous operation, the output of gate 110 goes low approximately two seconds after the correct code is entered into shift register 64. If this input is connected to the output of gate 112 by jumper 114, lock 10 is programmed for momentary operation, the output of gate 110 goes low approximately two seconds after the correct code is entered into shift register 64, but then goes high approximately two seconds later. When the output of gate 104 goes high, which happens approximately two seconds after the correct code has been entered into shift register 64, capacitor 116 is charged through resistor 118. Capacitor 116 and resistor 118 combine to yield a delay of approximately two seconds. Diode 120 serves to discharge capacitor 116 quickly when the output of gate 104 goes low, thereby resetting the delay. Gate 112 serves as a buffer. The output of gate 112 goes low after a delay of approximately four seconds after the correct code is entered into shift register 64. The output of gate 110 determines the state of the output of lock 10. Gate 110 is activated when its inputs are high. One input of gate 110 is connected to power reset 108 which goes high when Vcc reaches approximately eight volts. This prevents the output from erroneously turning on when power is initially applied to the logic. Another input of gate 110 goes high as soon as the correct code is entered into shift register 64 and the output from gate 94 goes high. If the code in shift register 64 is disturbed, this input goes low immediately, thereby disabling the output. When the output of gate 110 goes low, PNP transistor 122 turns on. The reed relay 124 is turned on. Diode 126 serves to prevent a voltage transiend from the coil of relay 124 from incurring damage when transistor 122 turns off.

Power reset circuit 108 is formed by NPN transistor 128 which is turned on at a threshold determined by zener diode 130 (6.8 volts), a slight voltage drop across resistor 132 (which is approximately equal to the Vbc of transistor 128) and Vbc of transistor 128. This makes the threshold of approximately eight volts. Resistor 134 serves to insure that transistor 128 turns off. Resistor 136 serves as the collector load resistor. Gate 138 serves as a buffer. The output of gate 138 is high when power is normal (twelve volts). Power reset 108 serves to insure that shift register 64 is reset and the output relay 124 is off when power is applied to the logic.

The power supply 140 is formed by diode 142, capacitor 144, zener diode 146 and resistor 148. Diode 142 rectifies AC that might be applied to the power input. If DC is applied, diode 142 protects against reverse polarity. Capacitor 144 serves as a filter to smooth out ripples and transients. Zener diode 146, in conjunction with resistor 148, protects the logic from temporary overvoltage at the power input.

Electronic lock 10 requires only a three-wire conductor to connect input contacts 12, 14 to the logic circuit. As mentioned previously, input contacts can be opened and closed by one three-position, spring return, center-off switch or two push buttons or equivalent keys. Multiple input stations are possible because they can be easily paralleled. Multiple coding is possible because the logic cards can easily be paralleled. When lock 10 is in the continuous mode, it can be disabled by operating one contact once, since this will disturb the contents of shift register 64. As described in the preferred embodiment, using a twelve-bit shift register 64, the odds against breaking the code are 4000 to 1.

In electronic lock 10 the predetermined code is set by the jumpers to contact 70 through 92. Changing the jumpers from one contact point to the other on one or more of flip-flips 40 to 72 will change or reset the predetermined code. Hence, in lock 10, the predetermined code is settable and resettable. Also, the mode of operation may be set to either momentary or continuous by changing jumper 114, as explained above.

Electronic lock 10 may be used to enable or disenable alarm systems; to open doors to apartments, homes, garages and restricted areas; to enable vehicle ignition systems; to enable the operation of dangerous machinery; and to gain access to restricted computer data.

I claim:

1. An electronic lock comprising:

two normally open electrical contacts serving as input means representing a binary zero and one;

means to close and reopen said input contacts;

an RS flip-flop loaded by the closing of one of said contacts with the binary digit represented by said contact;

a shift register loaded with the bit from said RS flip-flop when said input contact is reopened;

said shift register capable of being loaded with a plurality of bits, all bits being shifted one position as additional bits are entered;

said shift register containing a code to open said lock when said shift register is fully loaded with bits corresponding to a predetermined code;

at least one NAND gate;

said determined code being set by jumper wires from output terminals on said shift register to said NAND gate;

an integrating one-shot delay which receives the output of said NAND gate such that when said shift register contains said predetermined code, said delay is enabled;

a relay to open said lock at the end of said delay;

a power supply to furnish electrical power to said lock.

2. The electronic lock of claim 1 further comprising: means to enable said lock for momentary operation.

3. The electronic lock of claim 1 further comprising: a power reset circuit to clear said shift register upon initial application of power and after a power failure.

4. The electronic lock of claim 1 wherein the means to close and reopen said input contacts comprises:

a single pole, double pole, three-position, center-off switch;

a spring to return said switch to the center-off position.

5. The electronic lock of claim 1 wherein the means to close and reopen said input contacts comprises:

two push button switches.

6. The electronic lock of claim 1 wherein said predetermined code is set and reset by changing the contact points on said jumpers on said shift register.

7. The electronic lock of claim 1 further comprising: means to set said lock for continuous operation.

8. The electronic lock of claim 1 further comprising: means to set said lock for momentary operation.

* * * * *